United States Patent [19]

Bitvai

[11] 4,364,688

[45] Dec. 21, 1982

[54] ANCHORING BASE FOR ROAD SIGN POSTS AND THE LIKE

[76] Inventor: Tivadar Bitvai, Hägnegårdsvägen 6, 43600 Askim, Sweden

[21] Appl. No.: 224,539

[22] PCT Filed: Apr. 2, 1980

[86] PCT No.: PCT/SE80/00095

§ 371 Date: Dec. 6, 1980

§ 102(e) Date: Dec. 5, 1980

[87] PCT Pub. No.: WO80/02167

PCT Pub. Date: Oct. 16, 1980

[51] Int. Cl.[3] ..... E01F 9/00; E04H 12/22

[52] U.S. Cl. ..... 404/10; 40/607; 52/298

[58] Field of Search ..... 404/10, 9, 11; 40/607, 40/606, 608; 256/1, 13.1; 52/295, 296, 297, 298

[56] References Cited

U.S. PATENT DOCUMENTS

| | | | |
|---|---|---|---|
| 1,228,615 | 6/1917 | Stafford | 404/10 X |
| 1,284,376 | 11/1918 | Lehman | 40/608 |
| 1,643,955 | 10/1927 | Rank | 40/608 |
| 1,650,093 | 11/1927 | Rank | 40/608 X |
| 1,679,623 | 8/1928 | Olsen | 40/608 |
| 1,709,190 | 4/1929 | Rank | 40/608 |
| 1,760,270 | 5/1930 | Griswold | 40/608 |
| 3,212,415 | 10/1965 | Byrd | 404/10 |
| 3,308,584 | 3/1967 | Graham | 256/13.1 |
| 3,442,187 | 5/1969 | Hausegger | 404/11 |
| 3,618,556 | 11/1971 | Dittrich | 404/9 X |
| 3,717,326 | 2/1973 | Leach | 256/13.1 |
| 3,851,615 | 12/1974 | Grundvig | 404/9 X |

FOREIGN PATENT DOCUMENTS

| | | | |
|---|---|---|---|
| 646657 | of 1964 | Belgium | 404/10 |
| 572131 | 1/1976 | Switzerland | 404/10 |
| 1408463 | 10/1975 | United Kingdom | 404/10 |

*Primary Examiner*—Nile C. Byers, Jr.

[57] ABSTRACT

The invention relates to an anchoring base for road sign posts and the like, its object being to provide a post of such kind, which is easy to mount, and which easily can be re-mounted after the post has been prostrated, by way of example having been run into by a vehicle. The anchoring base comprises an upwardly open, cup-shaped bottom component (1, 21) and a weight (2, 22), which in mounted condition of the post (3, 23) is placed in the cavity of the bottom component, the weight in its turn supporting the post in question. The weight and the bottom component are held together by means of a vertical breakable connecting pin (10, 30) inserted into coaxially located cavities of the two components.

10 Claims, 7 Drawing Figures

ANCHORING BASE FOR ROAD SIGN POSTS AND THE LIKE

The present invention relates to a base for road sign posts and the like.

It is a principal object of the invention to provide a base of the kind mentioned, which is easy to erect, either for permanent or temporary use. It is further an object of the invention to provide a base, which is built in such a manner that as little damage as possible will be caused by a vehicle running into the post supported by the base.

This object is reached by means of the invention, which essentially is characterized by the anchoring base comprising an upwardly open, cup-shaped bottom component and in mounted condition of the post a weight housed in the hollow space of said bottom component, which weight in its turn supports the post in question, the weight and the base being mutually connected by means of a breakable connecting pin inserted into mutually coaxially located holes of said two components.

Figure 1:
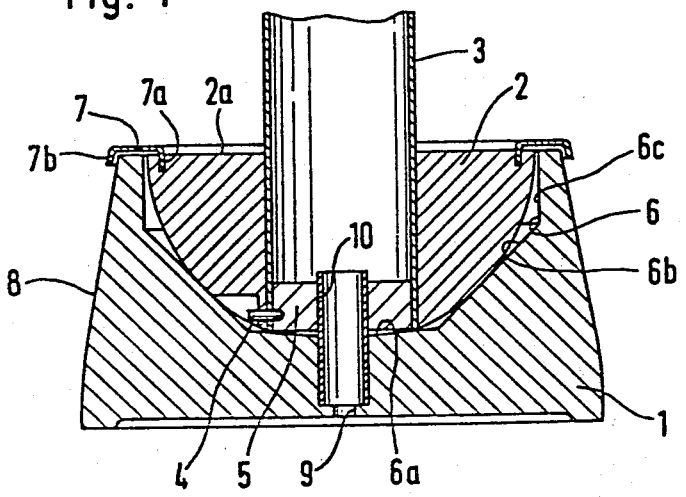
Figure 2:
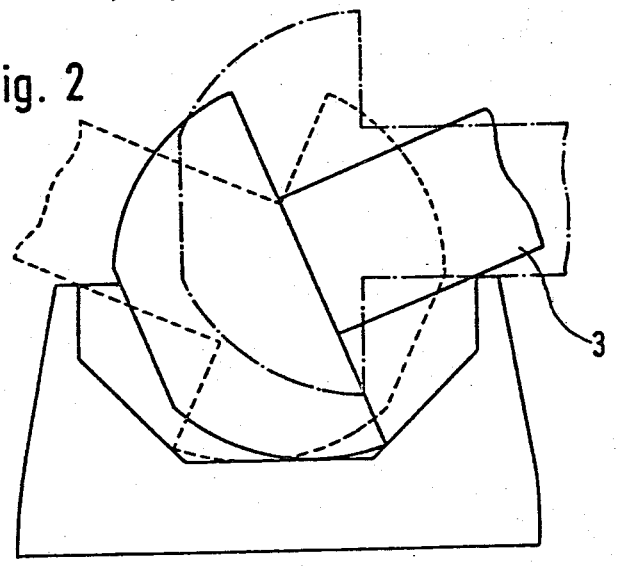
Figure 3:
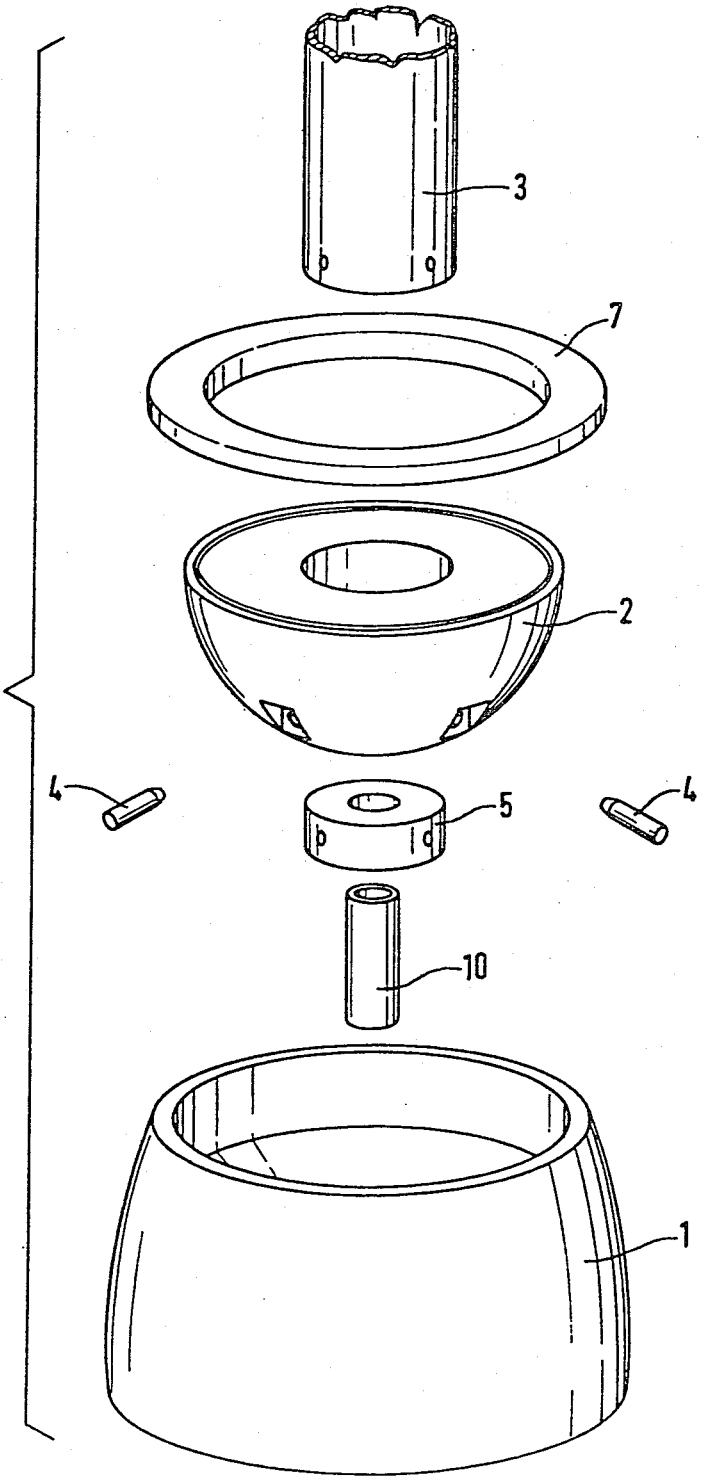
Figure 4:
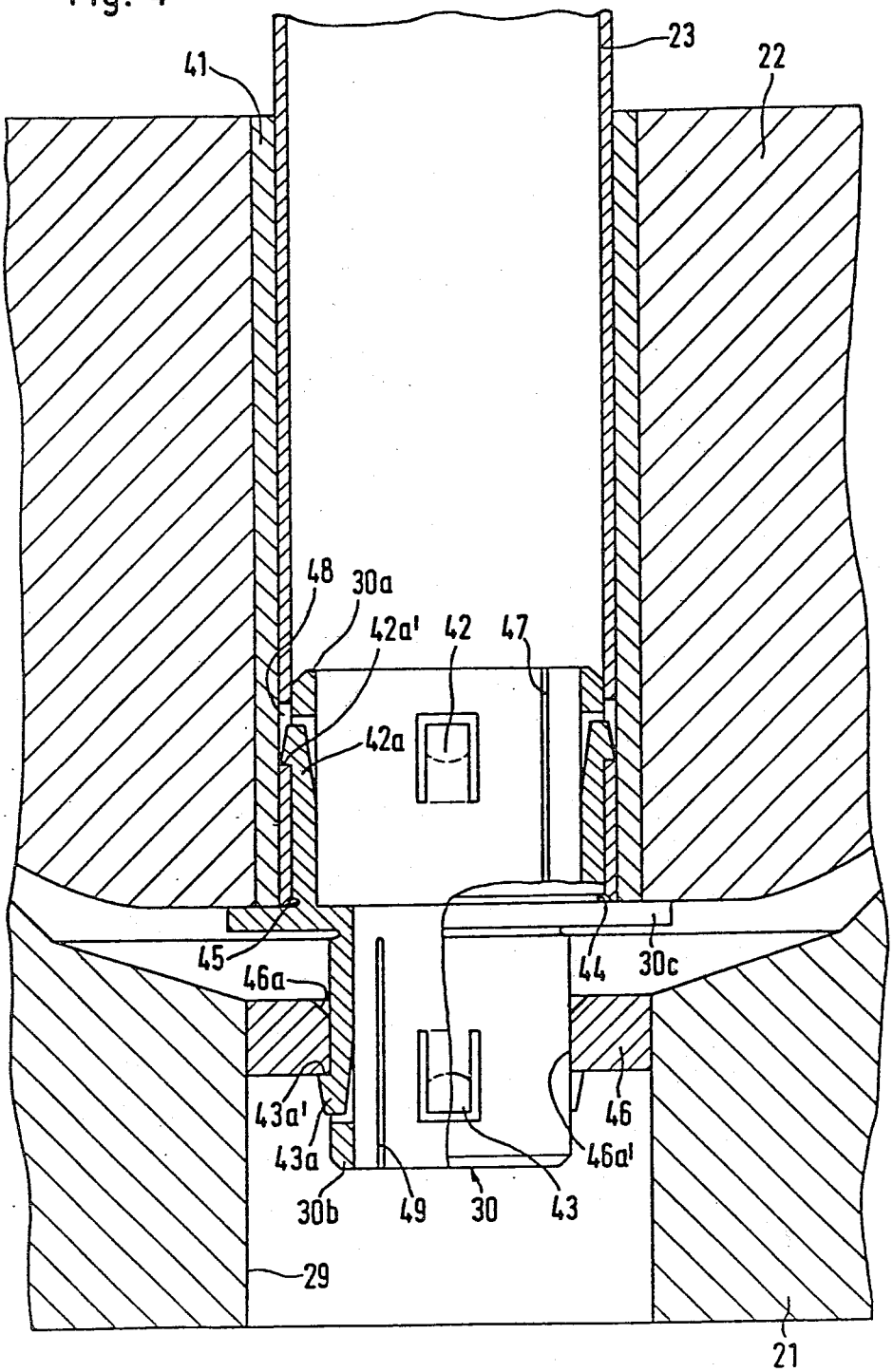
Figure 5:
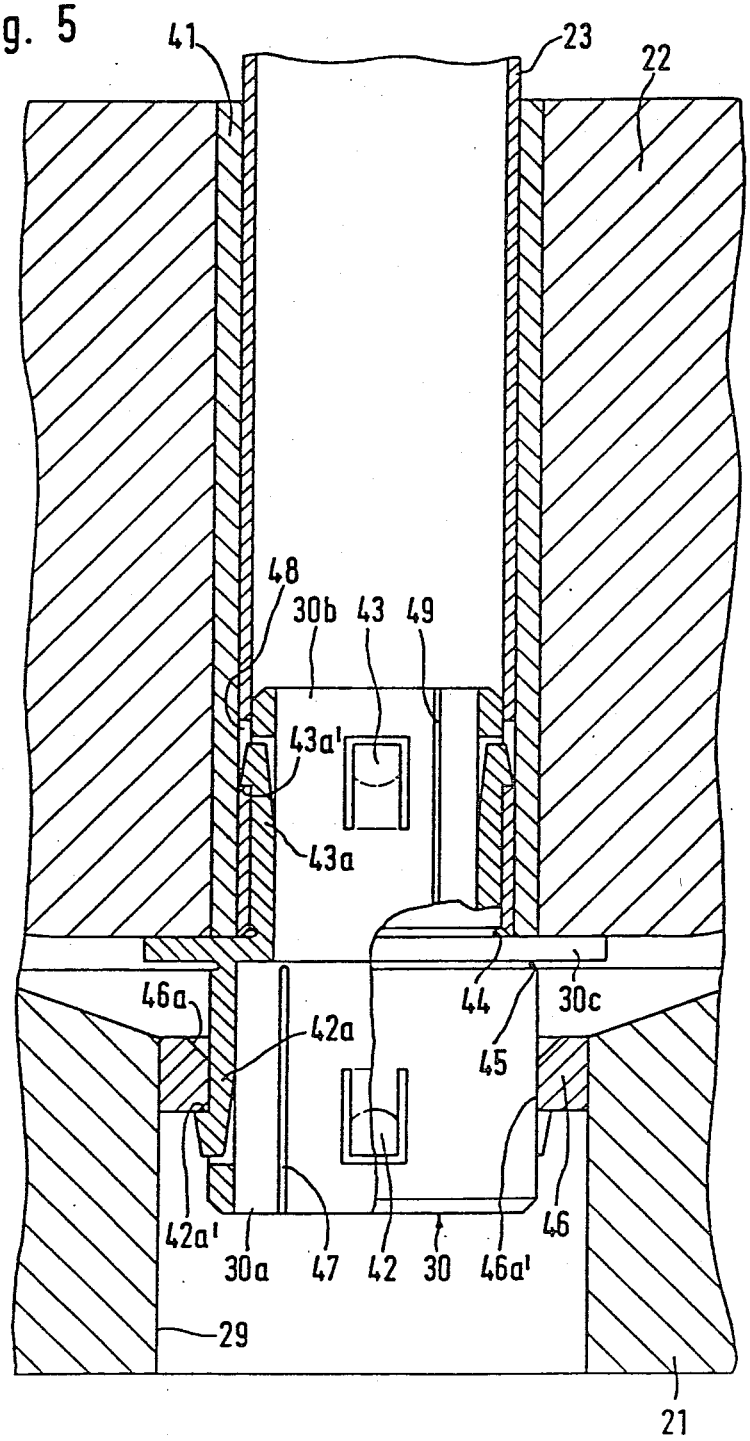
Figure 6:
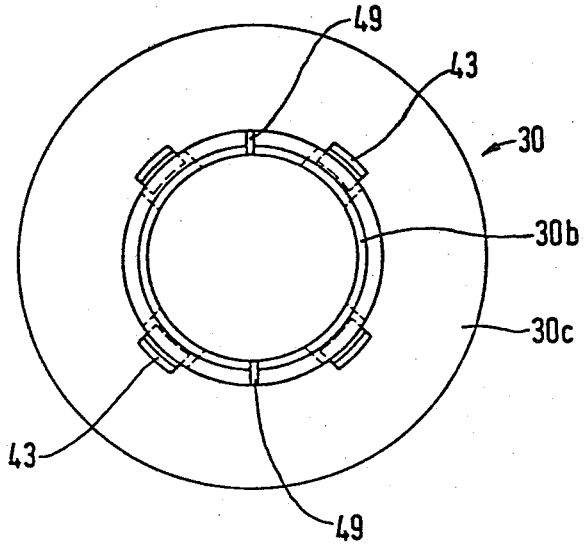
Figure 7:
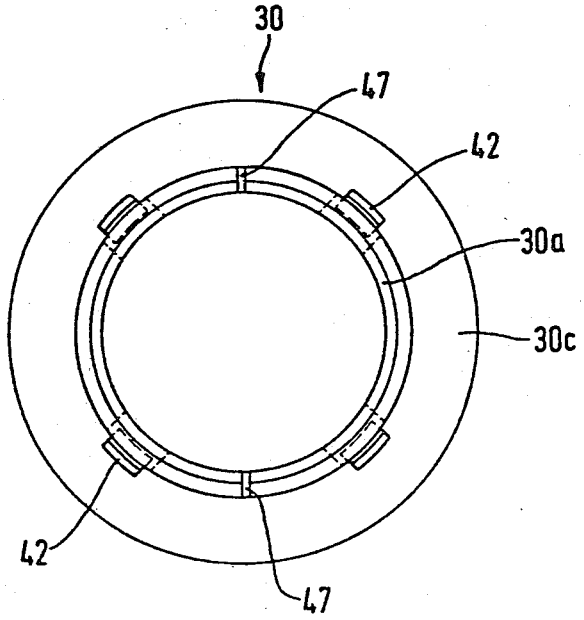

The invention will be described in the following, reference being made to the accompanying drawings, in which FIG. 1 is a cross-sectional view of a base made in accordance with a first embodiment of the invention, FIG. 2 is a schematic view of the same cross-section showing the post in different prostrating stages, FIG. 3 is an exploded view of the same base, FIG. 4 is a cross-sectional view corresponding to the one of FIG. 1 through the mid portion of a base made according to a second embodiment of the invention, FIG. 5 is a cross-sectional view corresponding to the one of FIG. 4 through a base according to a third embodiment, FIG. 6 is a bottom view of a detail illustrated in FIG. 4, and FIG. 7 is a top view of the same detail illustrated in FIG. 4.

The base illustrated in FIGS. 1-3 and made in accordance with the invention comprises a bottom component 1, a top component 2 of heavy material acting as a weight, and a post 3 supported by said top component, only the lower portion of said post being shown in the drawings. The weight 2 is provided with a central hole, which substantially has the same diameter as the outer diameter of the post 3. The weight 2 is held to the post 3 by means of radially interspaced pins 4, which traverse the weight 2 and radial bores made in the post 3. A body 5 of annular shape is provided in the interior of the post at its lower end, into which body the pins 4 also extend. The annular body has a central bore, in which a centre-sleeve 10 is in the mounted condition inserted, said centre-sleeve also extending down through a corresponding bore of the bottom component 1. The weight 2 rests in a recess 6 in the bottom component 1. This recess has a comparatively flat bottom portion **6*a*, a sloping bottom portion 6*b*, which has the form of the convex surface portion of a frustrum of a cone, and a substantially vertical top portion 6*c*. The semispherical weight 2 has a top side, which substantially extends in radial direction relative to the post 3. In order to impede penetration of rainwater and dirt into the recess 6 of the bottom component, the interspace between the weight 2 and the wall portion of the bottom component 1 is bridged by a lid 7, in cross-section having the form of an inverted U, the inner flange 7*a* of said lid extending down into an annular groove in the weight 2 and the outer flange 7*b* of said lid extending downwards along the outside 8 of the bottom component. A central bore 9 is made in the bottom component and extends coaxially to the sleeve 10, said bore in the first place being intended for passage of a wire, but which of course also can serve the purpose of a drainage means. The bore 9 is of a diameter, which is smaller than the one of the bore, to which it connects, and in which the sleeve 10 is inserted. By this arrangement a shoulder is formed at the passage between the two bores, against which shoulder the lower end of the sleeve rests. The bottom component 1 is suitably made of a comparatively heavy material, by way of example concrete, and may either be cast in position in the road bed or be provisionally placed on top of the same. The weight 2 is likewise suitably made of concrete. It can of course also be imagined to make the weight of any other suitable material. The sleeve 10 forms a breakable connecting pin between the weight 2 and the bottom component 1, and if passage of a wire is not desired, it can be made of solid material. However, the pin 10 shall be so weak that it is broken off, when the post 3 is subjected to a comparatively violent force, which is for example the case, when a vehicle runs into it. The spherical outer surface of the weight 2 will slide against the sloping bottom portion 6*b* of the recess 6 and occupy a position indicated with continuous lines in FIG. 2, in which position the post 3 rests against the upper edge portion of the bottom component. If the vehicle having run into the post should continue its movement and tend to carry along the post in its travelling direction, the top side 2*a* of the weight 2 will strike at the surface 6*c* of the bottom component, whereby the weight is prevented from falling out of said bottom component. If the movement of the vehicle should continue past this position, the breakable pins 4 will be shorn off, and the vehicle only carries along the post 3. Thanks to the cooperation between the weight 2 and the recess 6 a possibly existing wiring in the post will remain intact in case the post is only pivoted down and not carried along bringing in its train that it emerges from the weight 2. In order to prevent an unauthorized removal of the post from its base, the sleeve 10** can suitably have a comparatively great vertical extension, so that the post has to be lifted high up in order to permit being carried away from the pin.

The mounting of a post according to the kind described above can by way of example take place in such a way that the bottom component 1 is placed on top of the road bed or is cast into the same. Thereafter the post with its weight 2 in mounted condition can be threaded over the sleeve 10.

The base illustrated in the FIGS. 4, 6 and 7 differs from the base shown in the preceding figures, principally with respect to for one thing the central sleeve 30, which connects the post 23 and the weight 22 with the bottom component 21, and for another thing the gripping means of the sleeve.

The weight 22 in a central position has a sleeve 41, which is embedded in or in any other suitable manner fastened to the same, said sleeve suitably being made of metal or plastics. The inner diameter of the sleeve 41 corresponds to the outer diameter of the post 23, which is designed as a tube. The sleeve 30 has two end portions **30*a* and 30*b* with different diameters and which are mutually connected via an intermediate portion 30*c*, which forms a radially projecting flange. According to FIG. 4 the outer diameter of the upper sleeve portion 30***a* corresponds to the inner diameter of the tubular post 23. The lower portion 30*b* of the sleeve is suitably made with a diameter, which corresponds to some other dimension of tubular posts on the market, by way of example as will be described in connection with FIG. 5. Both end portions of the sleeves 30*a* and 30*b* are provided with hook-shaped tongues 42 and 43 respectively and interspaced round the periphery of the sleeve, each one of said tongues having a nose 42*a* and 43*a* respectively projecting outside of the periphery of the sleeve, said nose forming a shoulder 42*a'* and 43*a'* respectively facing away from the flange 30*c*. In the embodiment shown the tongues are cast of the same material as and integrated with the other part of the sleeve 30. The end portions 30*a* and 30*b* near the flange have peripheral cuts 44 and 45 respectively, which constitute fraction indications, by means of which the rupture point on the sleeve, when the post is prostrated, can be determined. In the central hole 29 in the bottom component 21, which hole is comparatively large compared with the central hole 9, which is shown in FIG. 1, a filling ring 46 is pressed in, the inner diameter of which corresponds to the outer diameter of the sleeve portion 30*b*. The filling ring in its upper portion has a chamfer 46*a*. The end portions of the sleeve 30 are provided with axially extending slits 47, 49, which extend from the free ends to the cut located at the flange. In the wall of the tubular post 23 engagement openings 48 are made, which are interspaced along the periphery of the tube in the same manner as the engaging tongues 42 and at a distance from the lower end of the tube 23, which corresponds to the distance between the flange 30*a* and the shoulder 42*a'* of the engaging tongues 42.

The mounting of the post is suitably carried out in such a way that it is inserted into the weight 22 until it reaches the position illustrated in FIG. 4, whereafter the sleeve 30 is inserted so far that the engaging tongues 42 snap in the corresponding engaging recesses 48. The flange 30*c* is then lying against the lower terminal edge of the tube 23 and the weight 22. The filling ring 46 has suitably beforehand been pressed into the central hole 29 of the bottom component 21. When the post together with the weight 22 and the sleeve 30 are brought down into the bottom component, and the end portion 30*b* of the sleeve is through the centerhole 46*a* introduced into the position shown in FIG. 4, the nose portions 43*a* of the engaging tongues 43 snap in below the filling ring, whereafter the post is firmly held in upright position.

When the post is subjected to a prostrating movement, which by way of example can occur, when a vehicle runs into it, the lower sleeve portion 30*b* below the flange 30*c* is broken off at the point of attenuation. Due to the longitudinally extending slits the components forming part of the sleeve portion in question fall down, so that their engagement ceases and they can be removed to permit the insertion of a new sleeve in order to again mount the post. The peripherical portions of the bottom component 21 and the weight 22, not shown in FIG. 4, can have a similar design as the corresponding parts in FIGS. 1 and 2. By this arrangement a counter-acting force is created against a run-down post being carried along by the vehicle, which has run into it, the performance being similar to the manner described in connection with the previous embodiment. Because of the fact that in connection with light pulling forces working on the post 23, after it has been prostrated, the flange still lies against the underside of the weight, the post and the weight are by means of the remaining sleeve portion kept together. Only in connection with a more powerful pull at the post, also the sleeve will break at the point of attenuation located above the flange, and the post will be drawn out of the weight.

A tubular post 23 is illustrated in FIG. 5, and its inner diameter corresponds to the outer diameter of the thinner portion of the sleeve 30 in FIG. 4. In this case the sleeve has been turned upside down relative to FIG. 4, and a thinner filling ring 46 has been pressed-in in the bore 29 of the bottom component 21. Thus, one and the same sleeve 30 can be used for two different diameters of the tubular post 23. Corresponding parts have been given the same reference numbers in FIG. 4 and FIG. 5.

The invention is not limited to the anchoring base described above and illustrated in the drawings by way of example only, but can be varied as to its details within the scope of the following claims without therefore departing from the fundamental idea of the invention. The weight indicated with 2 needs not to be made of as heavy material as concrete or metal. However, it is important that it does not fall out of the recess of the bottom component, when the post is rapidly prostrated. The invention can of course be applied to all kinds of posts, which may be subjected to violent lateral stresses such as occur when for example being run into by a vehicle.

I claim:

1. In combination: a base having a first cavity open at the top, a weight received in said first cavity and having an essentially flat top, a post supported by said weight, first breakable means interconnecting said base and said weight, said first interconnecting means including a pin inserted into coaxially arranged second cavities in said weight and in said base, and second breakable means interconnecting said weight and said post, said first cavity being defined in part by a substantially vertically extending portion adjacent the top of said cavity and adapted to cooperate with said flat top of said base in such a way that when said first connecting means is broken and said post is brought from an upstanding to a prostrate position said flat top engages and is held to said base by said substantially vertically extending portion, and that said second connecting means breaks before said weight becomes disengaged from said base.

2. The combination according to claim 1, wherein said second breakable connecting means include a plurality of radial pins interconnecting said weight and the lower end of said post.

3. The combination according to claim 1 or 2, wherein said cavity is defined in part by a sloping portion below said substantially vertically extending portion, and wherein said weight is substantially semi-spherical resting on said sloping portion.

4. The combination according to claim 1, wherein said second breakable means comprises a breakable sleeve one end portion of which extends into the lower end of said post and the opposite end portion of which extends into a central bore in said weight.

5. The combination according to claim 4, wherein said sleeve has a flange-like intermediate portion interconnecting said two end portions, and at least one peripheral weakened portion in said sleeve end portions adjacent said flange-like intermediate portion.

6. The combination according to claim 4, wherein said sleeve has a flange-like intermediate portion interconnecting said two end portions, and one peripheral weakened portion each on opposite sides of said intermediate portion in said sleeve end portions.

7. The combination according to any one of claims 4 to 6, at least one of said sleeve end portions being provided with hook portions adapted to engage openings in said post to thereby connect said post to said weight.

8. The combination according to any one of claims 4 to 6, both of said sleeve end portions being provided with hook portions adapted to engage openings in said post to thereby connect said post to said weight.

9. The combination according to claim 7, wherein said sleeve end portions are provided with axial slits extending from the respective end of the sleeve portion into the area of said weakened portion.

10. The combination according to claim 8, wherein said sleeve end portions are provided with axial slits extending from the respective end of the sleeve portion into the area of said weakened portion.

* * * * *

UNITED STATES PATENT AND TRADEMARK OFFICE

CERTIFICATE OF CORRECTION

PATENT NO. : 4,364,688

DATED : December 21, 1982

INVENTOR(S) : Tivadar Bitvai

It is certified that error appears in the above-identified patent and that said Letters Patent are hereby corrected as shown below:

On the title page:

Add the following item:

[30] Foreign Application Priority Data

April 6, 1979 [SE] Sweden.....79 03074

Signed and Sealed this

Fifth Day of April 1983

[SEAL]

Attest:

GERALD J. MOSSINGHOFF

Attesting Officer

Commissioner of Patents and Trademarks